US007719503B2

(12) United States Patent
Hosihara et al.

(10) Patent No.: US 7,719,503 B2
(45) Date of Patent: May 18, 2010

(54) DISPLAY DEVICE AND DRIVING METHOD OF DISPLAY DEVICE

(75) Inventors: Taizo Hosihara, Kumamoto (JP); Hideyuki Noguchi, Kanagawa (JP); Takashi Hirakawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 775 days.

(21) Appl. No.: 11/563,770

(22) Filed: Nov. 28, 2006

(65) Prior Publication Data

US 2007/0146281 A1 Jun. 28, 2007

(30) Foreign Application Priority Data

Nov. 29, 2005 (JP) ..... P2005-343121

(51) Int. Cl.
*G09G 3/36* (2006.01)

(52) U.S. Cl. ..... 345/87; 345/100; 345/204

(58) Field of Classification Search ..... 345/204, 345/690, 87–102, 211
See application file for complete search history.

(56) References Cited

U.S. PATENT DOCUMENTS 7,145,535 B2 * 12/2006 Takako et al. ..... 345/87

FOREIGN PATENT DOCUMENTS

JP 2000-330093 11/2000
JP 2005-077508 3/2005

* cited by examiner

*Primary Examiner*—Duc Q Dinh
(74) *Attorney, Agent, or Firm*—Sonnenschein Nath & Rosenthal LLP

(57) ABSTRACT

Disclosed herein is a display device using a field inversion driving system, the display device being formed by arranging pixels each including an electrooptic element in a form of a matrix and inverting polarity of a display signal to be written to each of the pixels in field periods, the display device including: double-speed converting means for converting an input display signal into a double-speed display signal having a field frequency twice a field frequency of said display signal; and crosstalk correcting means for correcting crosstalk in a second field of two fields as a unit of said double-speed display signal generated by said double-speed converting means, using information of the first field.

5 Claims, 13 Drawing Sheets

| | | | | | | | | | | | | | | | |
|---|---|---|---|---|---|---|---|---|---|---|---|---|---|---|---|
| 0 | 0 | 0 | -4 | -4 | 4 | 4 | 4 | 4 | 4 | 4 | 4 | 4 | 0 | 0 | 0 |

FIG. 12A

A

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 2 | 2 | 2 | 2 | 2 | 2 | 2 | 2 | 2 | 2 | 0 | 0 | 0 |
| 0 | 0 | 0 | 4 | 4 | 4 | 4 | 4 | 4 | 4 | 4 | 4 | 4 | 0 | 0 | 0 |
| 0 | 0 | 0 | 4 | 4 | 4 | 4 | 5 | 5 | 5 | 5 | 5 | 5 | 0 | 0 | 0 |
| 0 | 0 | 0 | 2 | 2 | 4 | 4 | 5 | 5 | 5 | 5 | 5 | 5 | 0 | 0 | 0 |
| 0 | 0 | 0 | 0 | 0 | 4 | 4 | 4 | 4 | 4 | 4 | 4 | 4 | 0 | 0 | 0 |
| 0 | 0 | 0 | -2 | -2 | 4 | 4 | 2 | 2 | 2 | 2 | 2 | 2 | 0 | 0 | 0 |
| 0 | 0 | 0 | -4 | -4 | 4 | 4 | 4 | 4 | 4 | 4 | 4 | 4 | 0 | 0 | 0 |
| 0 | 0 | 0 | -4 | -4 | 4 | 4 | 4 | 4 | 4 | 4 | 4 | 4 | 0 | 0 | 0 |
| 0 | 0 | 0 | -4 | -4 | 4 | 4 | 4 | 4 | 4 | 4 | 4 | 4 | 0 | 0 | 0 |

FIG. 12B

| | | | | | | | | | | | | | | | |
|---|---|---|---|---|---|---|---|---|---|---|---|---|---|---|---|
| 0 | 0 | 0 | -12 | -12 | 12 | 12 | 12 | 12 | 12 | 12 | 12 | 12 | 0 | 0 | 0 |
| 0 | 0 | 0 | -12 | -12 | 12 | 12 | 12 | 12 | 12 | 12 | 12 | 12 | 0 | 0 | 0 |
| 0 | 0 | 0 | -12 | -12 | 12 | 12 | 12 | 12 | 12 | 12 | 12 | 12 | 0 | 0 | 0 |
| 0 | 0 | 0 | -22 | -22 | 2 | 2 | 2 | 2 | 2 | 2 | 2 | 2 | 0 | 0 | 0 |
| 0 | 0 | 0 | -32 | -32 | -8 | -8 | -8 | -8 | -8 | -8 | -8 | -8 | 0 | 0 | 0 |
| 0 | 0 | 0 | -32 | -32 | -8 | -8 | -13 | -13 | -13 | -13 | -13 | -13 | 0 | 0 | 0 |
| 0 | 0 | 0 | -22 | -22 | -8 | -8 | -13 | -13 | -13 | -13 | -13 | -13 | 0 | 0 | 0 |
| 0 | 0 | 0 | -12 | -12 | -8 | -8 | -8 | -8 | -8 | -8 | -8 | -8 | 0 | 0 | 0 |
| 0 | 0 | 0 | -2 | -2 | -8 | -8 | 2 | 2 | 2 | 2 | 2 | 2 | 0 | 0 | 0 |
| 0 | 0 | 0 | 8 | 8 | -8 | -8 | -8 | -8 | -8 | -8 | -8 | -8 | 0 | 0 | 0 |
| 0 | 0 | 0 | 8 | 8 | -8 | -8 | -8 | -8 | -8 | -8 | -8 | -8 | 0 | 0 | 0 |
| 0 | 0 | 0 | 8 | 8 | -8 | -8 | -8 | -8 | -8 | -8 | -8 | -8 | 0 | 0 | 0 |

DISPLAY DEVICE AND DRIVING METHOD OF DISPLAY DEVICE

CROSS REFERENCES TO RELATED APPLICATIONS

The present invention contains subject matter related to Japanese Patent Application JP 2005-343121 filed in the Japanese Patent Office on Nov. 29, 2005, the entire contents of which being incorporated herein by reference.

BACKGROUND OF THE INVENTION

1. Field of the Invention

The present invention relates to a display device and a driving method of a display device, and particularly to an active matrix type display device formed by two-dimensionally arranging pixels each including an electrooptic element in the form of a matrix and a driving method of the display device.

2. Description of the Related Art

A display device formed by arranging pixels each including an electrooptic element in the form of a matrix, for example an active matrix type liquid crystal display device formed by two-dimensionally arranging pixels each including a liquid crystal cell, the liquid crystal cell being used as an electrooptic element, in the form of a matrix generally employs an alternating-current driving system that inverts the polarity of a display signal in certain periods with a common potential Vcom as a center in order to prevent degradation of liquid crystal and image burn-in in an alignment layer due to continuous application of a direct-current voltage of the same polarity to the liquid crystal.

FIGS. 13A and 13B are diagrams of assistance in explaining a field inversion driving system that inverts the polarity of a display signal in field periods. FIG. 13A shows, for example, a pixel arrangement of four rows and four columns. FIG. 13B shows a driving waveform for each pixel in the pixel arrangement.

This field inversion driving system has a problem of degradation in display quality due to a so-called vertical crosstalk caused by a leak of pixel transistors for switching liquid crystal cells. Specifically, as shown in FIG. 14, when a normally white type liquid crystal display device (a liquid crystal display device that decreases transmittance as voltage applied to liquid crystal is raised), for example, displays a black window on a gray background, a problem occurs in pixels in gray areas 02 and 03 situated in a direction of vertical scanning (top-to-bottom direction) of a black area 01 in that the pixels in the area 02 over the black area 01 appear darker than original gray and the pixels in the area 03 under the black area 01 appear lighter than the original gray.

The problem of this vertical crosstalk occurs because field inversion driving switches between positive polarity driving and negative polarity driving in field units, and thereby changes potentials between the common electrodes of pixels, source wiring, and gates, resulting in a difference between an amount of leakage (amount of crosstalk) of pixel transistors in the upper area 02 and an amount of leakage (amount of crosstalk) of pixel transistors in the lower area 03.

Making more concrete description, when the pixels are written with a positive polarity (or a negative polarity) in a certain field, and written with a negative polarity (or a positive polarity) in a next field, in a stage of writing the black area 01, the polarity of a row being written and the polarity of the upper area 02 are the same negative polarity, whereas the polarity of the lower area 03 yet to be written remains the positive polarity of the previous field.

Thus, with respect to a potential to be written to the black area 01, the polarity of a potential retained by the pixels in the upper area 02 is different from the polarity of a potential retained by the pixels in the lower area 03, resulting in a difference between the amounts of leakage of the pixel transistors in the upper area 02 and the lower area 03. Therefore, the upper area 02 over the black area 01 appears darker than the original gray, and the lower area 03 under the black area 01 appears lighter than the original gray.

To deal with degradation in display quality due to such a vertical crosstalk in related art, image data for each pixel is corrected such that even when the potential of a pixel electrode is changed with a potential change, the potential of the pixel electrode coincides with an average potential within a frame when it is assumed that the change in the potential of the pixel electrode does not occur (see for example, Japanese Patent Laid-Open No. 2005-077508. Hereinafter refer to as Patent Document 1.).

Also known is a technique that uses a memory (line memory) having a capacity for one scanning line, stores a sum of information for one vertical column in a previous field, and corrects image data for each pixel in a present field using the information stored in the line memory (see for example, Japanese Patent Laid-Open No. 2000-330093. Hereinafter refer to as Patent Document 2).

SUMMARY OF THE INVENTION

However, the technique in related art described in Patent Document 1 needs a large-scale memory having a capacity to store image data for one screen. On the other hand, the technique in related art described in Patent Document 2 may not correct a moving image properly, and deals with a moving image by turning off a correcting function at the time of a moving image, so that degradation in display quality of a moving image is inevitable.

FIG. 15 is a diagram embodying a problem occurring at a time of a moving image when a line memory having a capacity for one line is used. As is clear from FIG. 15, when an image of an Nth field (present field) is shifted to the right by one pixel, for example, with respect to an image of an (N−1)th field (previous field), and the image data of the Nth field is corrected using information stored in the line memory, the correction is not performed properly.

In addition, both the techniques in related art described in Patent Document 1 and Patent Document 2 were devised assuming a 1-H inversion driving system that inverts the polarity of a display signal in one H (H is a horizontal period), and therefore may not deal with vertical crosstalk specific to the field inversion driving system, that is, vertical crosstalks whose amounts of crosstalk are different in the upper area 02 over the black area 01 and the lower area 03 under the black area 01.

Accordingly, it is desirable to provide a liquid crystal display device and a driving method thereof that can prevent degradation in display quality at a time of a moving image due to vertical crosstalk without using a large-scale memory having a capacity to store display data for one screen.

It is also desirable to provide a display device and a driving method thereof that can more reliably correct vertical crosstalk specific to the field inversion driving system.

According to an embodiment of the present invention, there is provided a display device using a field inversion driving system, the display device being formed by arranging pixels each including an electrooptic element in a form of a matrix and inverting polarity of a display signal to be written to each of the pixels in field periods, the display device being configured to convert an input display signal into a double-speed display signal having a field frequency twice a field frequency of the display signal, and correct crosstalk in a second field of two fields as a unit of the double-speed display signal, using information (e.g. image data) of the first field.

In the thus configured display device, the double-speed display signal has two fields as a unit, and information changes with the two fields as a unit. In other words, information is the same between the two fields as a unit. Hence, crosstalk correction is performed between the two fields where the information is not changed. Specifically, crosstalk is corrected in the second field using the information of the first field. The same correction as that for a still image can therefore be performed for a moving image.

According to another embodiment of the present invention, in crosstalk correction, the display device is configured to retain first sum total luminance information accumulated in each column for all rows of image information of the first field, and second sum total luminance information accumulated in each column up to a line immediately preceding a row to be written from now (or up to the row to be written from now) of image information of the second field, and perform a correcting operation using an independent correction coefficient for each correction area on a basis of the first sum total luminance information and the second sum total luminance information.

In the crosstalk correction, a correcting operation is performed on the basis of the first sum total luminance information and also the second sum total luminance information, and an independent correction coefficient can be set for each correction area. Therefore, even for vertical crosstalk specific to the field inversion driving system, that is, vertical crosstalks whose amounts of crosstalk are different in an area over a black area and an area under the black area, it is possible to set correction coefficients corresponding to the respective amounts of crosstalk.

According to yet another embodiment of the present invention, the same correction as that for a still image can be performed for a moving image, and therefore degradation in display quality at a time of a moving image can be prevented. In addition, because correction coefficients corresponding to the respective amounts of crosstalk in different correction areas can be set, vertical crosstalk specific to the field inversion driving system can be corrected more reliably.

The above and other features and advantages of the present invention will become apparent from the following description when taken in conjunction with the accompanying drawings which illustrate preferred embodiments of the present invention by way of example.

BRIEF DESCRIPTION OF THE DRAWINGS

FIGS. 12A and 12B are diagrams (2) of assistance in explaining the concrete example of the vertical crosstalk correction;

DETAILED DESCRIPTION OF THE PREFERRED EMBODIMENTS

Preferred embodiments of the present invention will hereinafter be described in detail with reference to the drawings.

Figure 1:
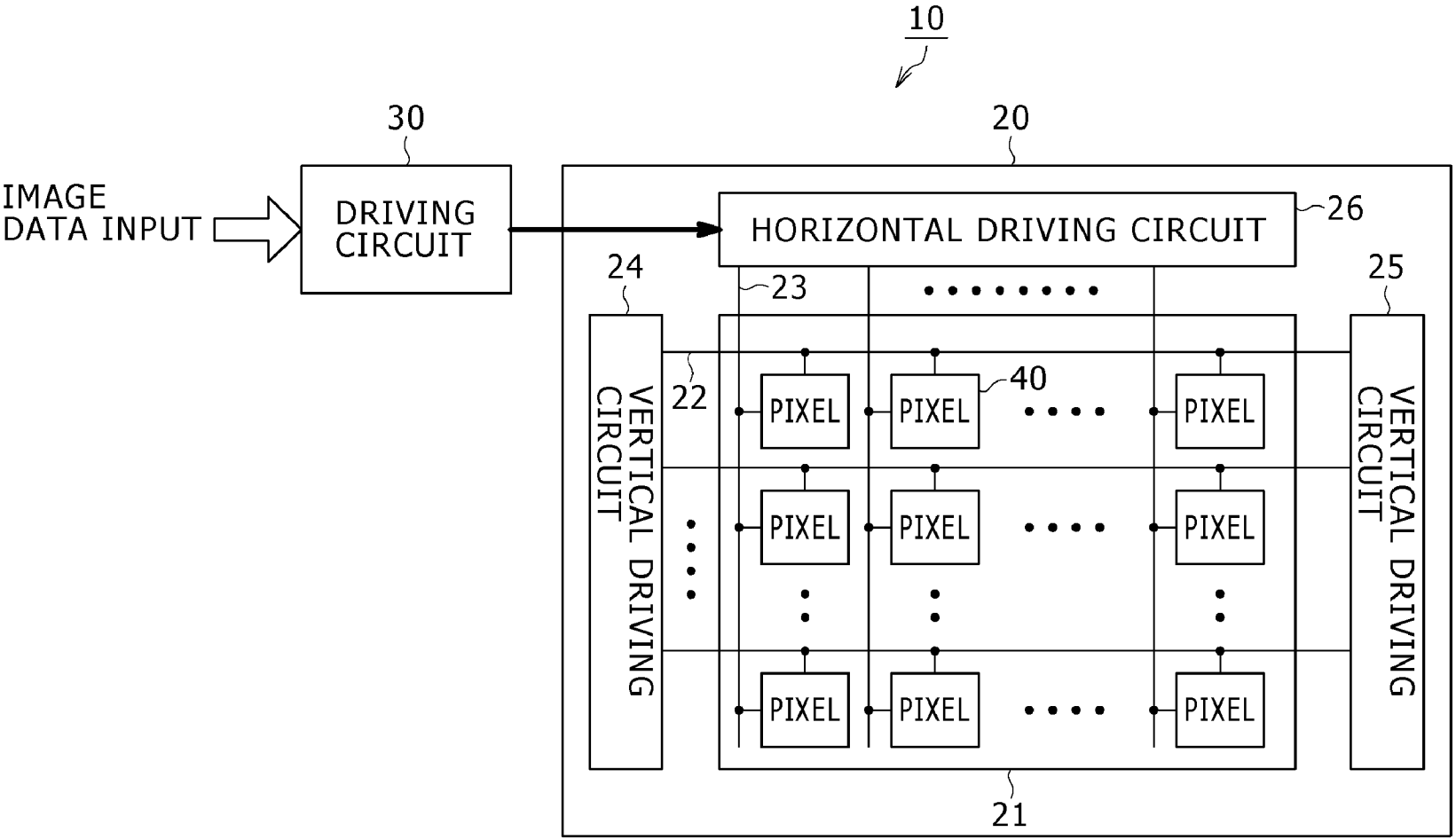
FIG. 1 is a system block diagram showing an outline of a configuration of a display device to which the present invention is applied.

FIG. 1 is a system block diagram showing an outline of a configuration of a display device to which the present invention is applied. Description in the following will be made by taking as an example an active matrix type liquid crystal display device using a liquid crystal cell as an electrooptic element of a pixel.

As shown in FIG. 1, the active matrix type liquid crystal display device 10 according to the present application example has a display panel (liquid crystal panel) 20 for displaying an image, and a driving circuit 30 for driving the display panel 20.

The display panel 20 is formed by arranging a transparent insulating substrate, for example a first glass substrate (not shown) including a pixel array unit 21 formed therein, in which unit pixels 40 each including a liquid crystal cell as an electrooptic element are arranged in the form of a matrix, and a second glass substrate such that the first glass substrate and the second glass substrate are opposed to each other with a predetermined space therebetween, and sealing in a liquid crystal material within the space.

The pixel array unit 21 has a scanning line 22 disposed for each row and a signal line 23 disposed for each column in the pixel arrangement in the form of a matrix. In addition to the pixel array unit 21, two vertical driving circuits 24 and 25 and a horizontal driving circuit 26, for example, are mounted as peripheral driving circuits for the pixel array unit 21 on the display panel (first glass substrate) 20.

(Pixel Circuit)

Figure 2:
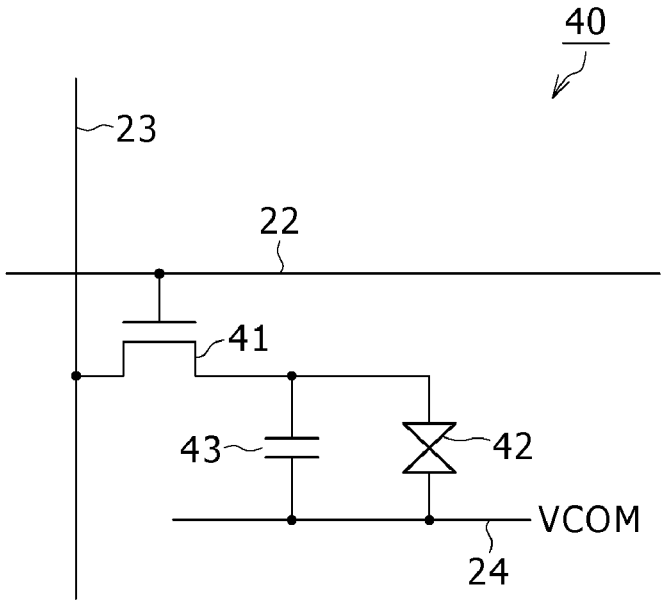
FIG. 2 is a circuit diagram showing an example of circuit configuration of a pixel.

FIG. 2 is a circuit diagram showing an example of circuit configuration of a pixel 40. As is clear from FIG. 2, the pixel 40 includes a pixel transistor, for example an N-type TFT (Thin Film Transistor) 41, a liquid crystal cell 42 having a pixel electrode connected to the drain electrode of the TFT 41, and a storage capacitor 43 having one electrode connected to the drain electrode of the TFT 41. The liquid crystal cell 42 refers to a liquid crystal capacitance occurring between the pixel electrode and a counter electrode formed so as to be opposed to the pixel electrode.

The TFT 41 has a gate electrode connected to a scanning line 22, and a source electrode connected to a signal line 23. In addition, for example, the counter electrode of the liquid crystal cell 42 and another electrode of the storage capacitor 43 are connected to a common line 24 common to each pixel. The counter electrode of the liquid crystal cell 42 and the other electrode of the storage capacitor 43 are supplied with a common potential (counter electrode voltage) VCOM common to each pixel via the common line 24.

Returning to FIG. 1, the two vertical driving circuits 24 and 25 are disposed on both of a left side and a right side with the pixel array unit 21 interposed between the vertical driving circuits 24 and 25. Incidentally, while in this case, the vertical driving circuits 24 and 25 are disposed on both of the left side and the right side of the pixel array unit 21, it is possible to employ a configuration having one vertical driving circuit 24 (25) disposed on one of the left side and the right side of the pixel array unit 21.

The vertical driving circuits 24 and 25 are formed by a shift register, a buffer circuit and the like. The vertical driving circuits 24 and 25 sequentially scan each row of the pixel array unit 21, and thereby select pixels 40 in a row unit. The horizontal driving circuit 26 is formed by for example a shift register, a sampling circuit, a buffer circuit and the like. The horizontal driving circuit 26 writes image data input from the external driving circuit 30 to each pixel 40 in the pixel row selected by the vertical driving circuits 24 and 25 in a pixel unit.

The driving circuit 30 includes a correcting circuit for performing correction processing on image data in order to prevent degradation in display quality due to vertical crosstalk. The correcting circuit corrects vertical crosstalk by correcting image data for each pixel between two fields. The present invention is characterized by a concrete configuration of this vertical crosstalk correcting circuit, and details of the vertical crosstalk correcting circuit will be described later.

The thus formed active matrix type liquid crystal display device 10 employs a field inversion driving system that reverses the polarity of image data as a display signal in field periods with the common potential VCOM as a center. This field inversion driving system needs high-speed driving as a measure against flicker. As a method for high-speed driving, a double-speed driving system using a field memory is generally employed.

In this double-speed driving system, as is well known, while image data for one field is written to a field memory within one vertical period, the image data for one field is read from the field memory twice within one vertical period, whereby double-speed image data is obtained. Hence, the same data is output as image data for two consecutive fields. This means that in other words, a moving image of two consecutive fields can be considered to be a still image.

Thus, output data in the field memory used for double-speed driving changes in units of two fields at a minimum. Therefore, when image data for each pixel is corrected between two fields as in correction of vertical crosstalk, the correction is activated only between the two fields between which no change occurs, and the correction is inactivated between the second field and a next field (between frames) between which a data change may occur, so that the same image data correction as that for a still image can be performed for a moving image. Consequently, degradation in display quality at the time of a moving image can be prevented, and the field memory is not required for the correction of vertical crosstalk.

That is, the present invention is characterized in that the same image data correction as that for a still image is performed for a moving image by activating the correction only between two fields as a unit of double-speed driving, and correcting vertical crosstalk in the second field using the information of the first field, so that degradation in display quality at the time of a moving image is prevented. Details of this will be described below concretely.

Consideration will first be given to vertical crosstalk. When a normally white type liquid crystal display device, for example, displays a window of a black color (hereinafter referred to as a "black window") in a screen having a gray background, a vertical crosstalk occurs in the form of a band having the width of the window on an upper side and a lower side of a writing row, as described above.

A vertical crosstalk appears as follows.

Figure 3:
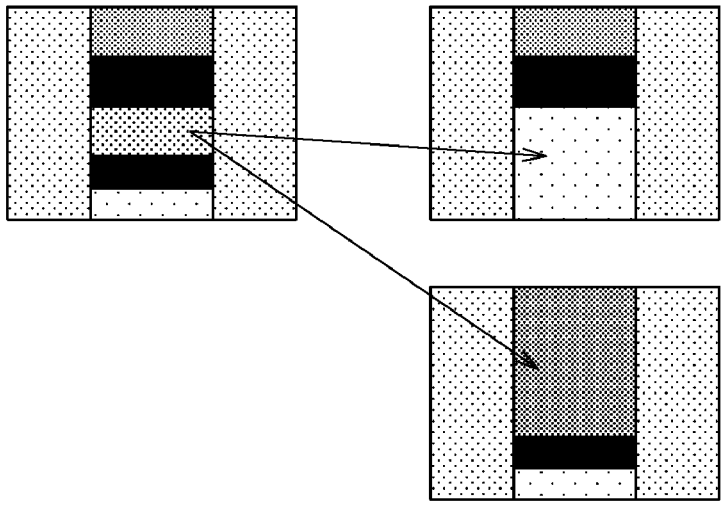
FIG. 3 is a diagram showing an example of an appearance of vertical crosstalk.
Figure 14:
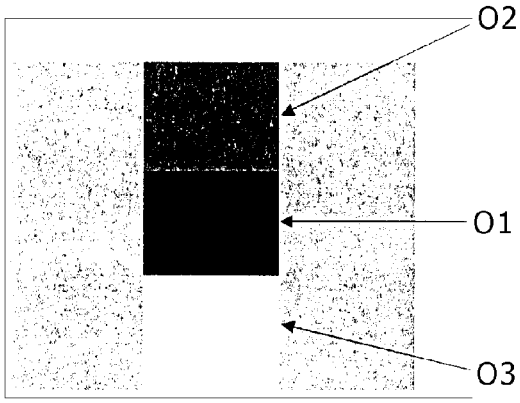
FIG. 14 is a diagram showing a state of vertical crosstalk occurring when a black window is displayed on a gray background.
Figure 15:
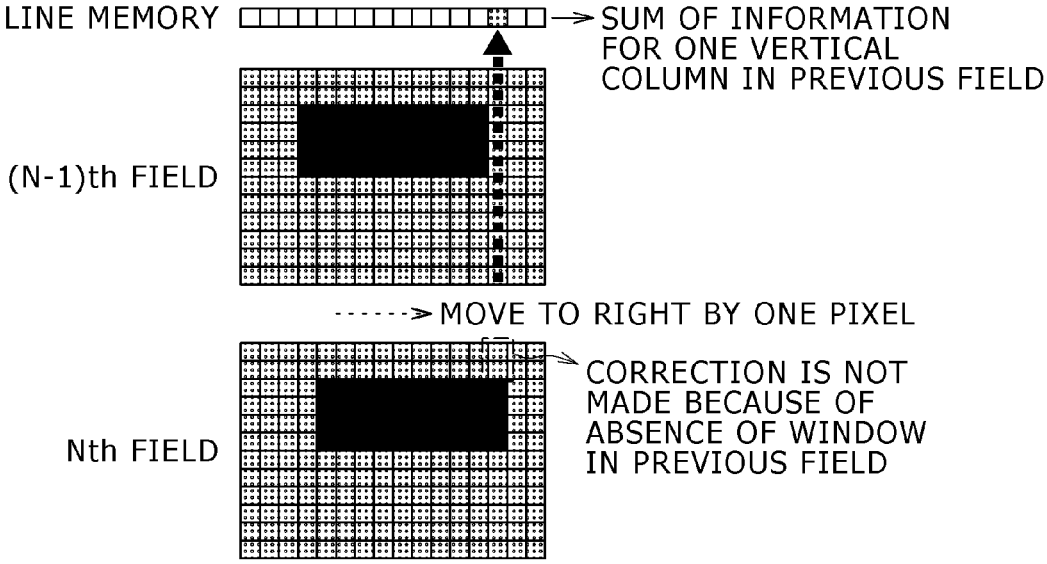
FIG. 15 is a diagram embodying a problem occurring at a time of a moving image when a line memory having a capacity for one line is used.

- A vertical crosstalk appears as a blackish part on the upper side of the black window (the side preceding the writing row), and as a whitish part on the lower side of the black window (the side subsequent to the writing row) (see FIG. 14).
- An amount of crosstalk (an amount of leakage of a pixel transistor (the TFT 41 in FIG. 2)) changes in proportion to the width of the black window.
- The amount of crosstalk changes in proportion to the writing level of the black window.
- The level of the crosstalk does not depend on the position of the black window, but depends on the quantity and gradation level of a black signal.
- When there are two black windows on an upper side and a lower side, an amount of crosstalk between the black windows is a sum of an amount of crosstalk determined by a window width and level on the upper side and an amount of crosstalk determined by a window width and level on the lower side (see FIG. 3).

From the above-described ways of appearance of vertical crosstalk, it can be said that in correcting vertical crosstalk, an amount of correction depends on a sum total of signal levels of rows on the upper side (an upward direction of scanning) of a writing row to which to write a signal from now and signal levels of rows on the lower side (a downward direction of scanning) of the writing row. A vertical crosstalk correcting circuit to be described below is formed in view of this point.

Embodiment

Figure 4:
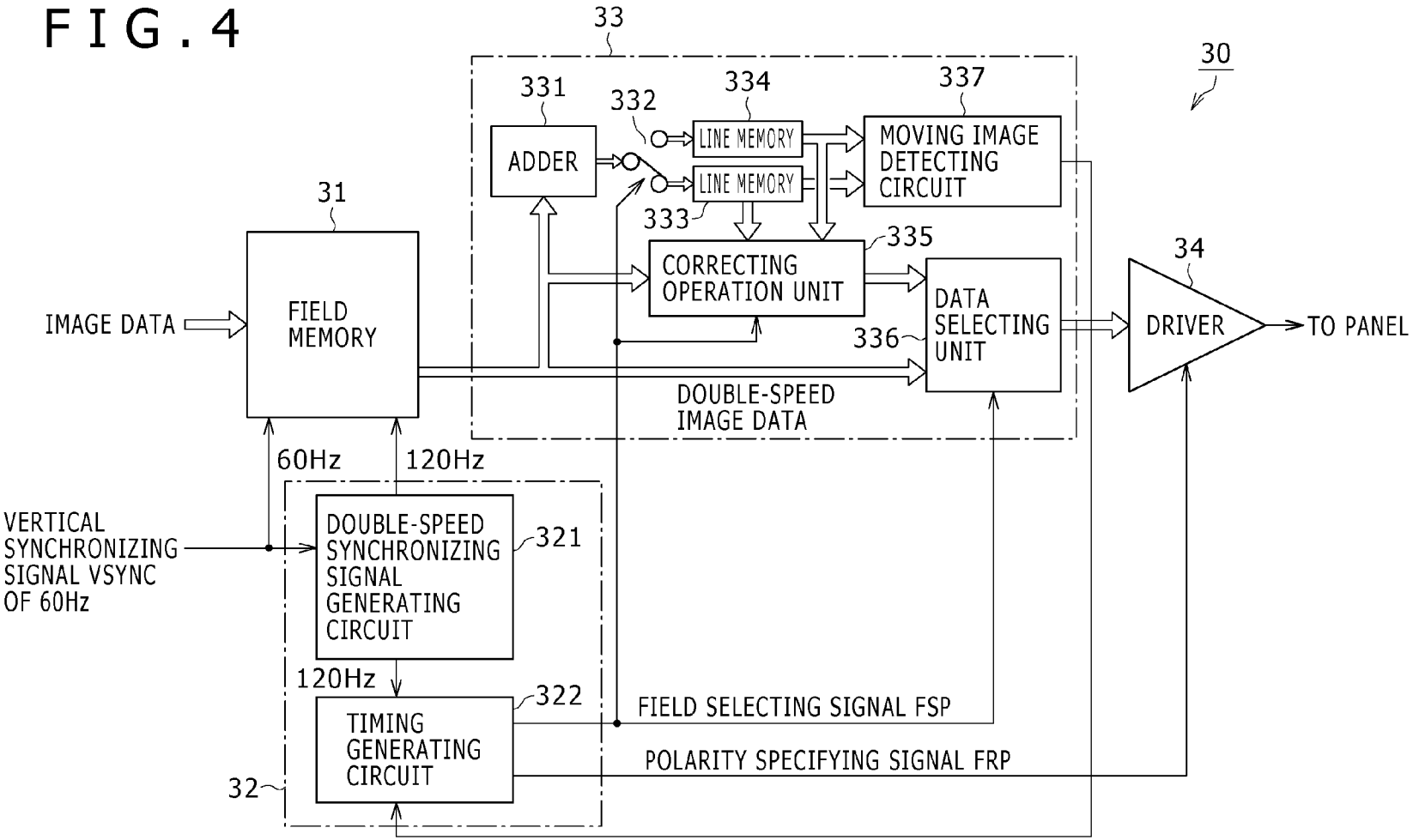
FIG. 4 is a functional block diagram of a driving circuit including a vertical crosstalk correcting circuit according to one embodiment of the present invention.

FIG. 4 is a functional block diagram of the driving circuit 30 including the vertical crosstalk correcting circuit according to one embodiment of the present invention.

As shown in FIG. 4, the driving circuit 30 includes: a field memory 31 used for double-speed driving; a control circuit 32 for controlling the writing/reading of image data to and from the field memory 31; a vertical crosstalk correcting circuit 33 for performing correction processing on the image data to prevent degradation in display quality due to vertical crosstalk; and a driver 34 for driving the display panel 20. The field memory 31 and the control circuit 32 form double speed converting means in claims.

The control circuit 32 includes a double-speed synchronizing signal generating circuit 321 and a timing generating circuit 322. The double-speed synchronizing signal generating circuit 321 in the control circuit 32 is supplied with a vertical synchronizing signal VSYNC of a predetermined frequency, for example 60 Hz as an input. The double-speed synchronizing signal generating circuit 321 halves the frequency of the vertical synchronizing signal VSYNC, and thereby generates a vertical synchronizing signal VS of 120 Hz (hereinafter described as a "double-speed synchronizing signal").

The control circuit 32 performs control to read image data for one field from the field memory 31 twice in synchronism with the double-speed synchronizing signal VS generated by the double-speed synchronizing signal generating circuit 321 while writing the digital image data for one field in synchronism with the externally input vertical synchronizing signal VSYNC. Thereby, the input image data (display signal) is converted into double-speed image data having a field frequency twice the field frequency of the image data, and the double-speed image data is output from the field memory 31.

Figure 5:
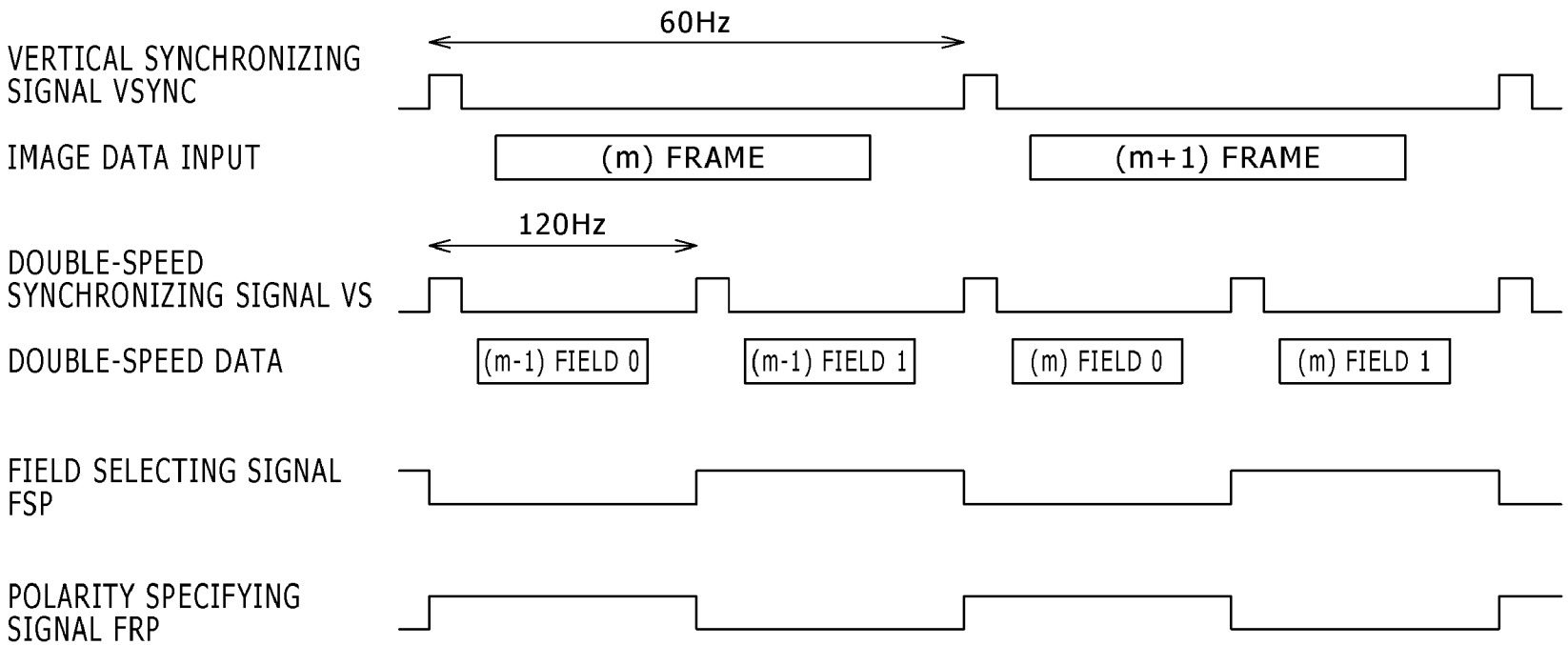
FIG. 5 is a timing chart representing a concept of a double-speed conversion process.

FIG. 5 represents a concept of a double-speed conversion process. As is clear from FIG. 5, the double-speed image data output from the field memory 31 is same data occurring consecutively in two fields. However, since the liquid crystal display device 10 employs the field inversion driving system, the polarity of the image data differs in each of the two fields where the same data occurs consecutively.

The timing generating circuit 322 in the control circuit 32 generates a field selecting signal FSP and a polarity specifying signal FRP on the basis of the double-speed synchronizing signal of 120 Hz generated by the double-speed synchronizing signal generating circuit 321.

As shown in FIG. 5, with two fields of double-speed image data as a unit, the field selecting signal FSP is a pulse signal having a first polarity, for example a negative polarity (hereinafter described as an "L" level) in the first field, and having a second polarity, for example a positive polarity (hereinafter described as an "H" level) in the second field. The field selecting signal FSP is supplied to the vertical crosstalk correcting circuit 33.

The field selecting signal FSP at the "L" level indicates that the image data output from the field memory 31 is the first field of the double-speed image data. The field selecting signal FSP at the "H" level indicates that the image data output from the field memory 31 is the second field of the double-speed image data.

As shown in FIG. 5, with two fields of the double-speed image data as a unit, the polarity specifying signal FRP is a pulse signal having opposite polarity (opposite phase) to that of the field selecting signal FSP, that is, having an "H" level in the first field and having an "L" level in the second field. The polarity specifying signal FRP is supplied to a driver 34.

The driver 34 converts digital image data output from the vertical crosstalk correcting circuit 33 into an analog image signal, and inputs the analog image signal to the display panel 20 as an analog image signal of negative polarity when the polarity specifying signal FRP is of the first polarity ("L" level) and as an analog image signal of positive polarity when the polarity specifying signal FRP is of the second polarity ("H" level).

As described above, the polarity specifying signal FRP is a pulse signal having the "H" level in the first field of the double-speed image data and having the "L" level in the second field of the double-speed image data. Hence, the analog image signal input to the display panel 20 is of positive polarity in the first field of the double-speed image data and is of negative polarity in the second field of the double-speed image data.

The vertical crosstalk correcting circuit 33 includes an adder 331, a selector switch 332, two line memories 333 and 334, a correcting operation unit 335, a data selecting unit 336, and a moving image detecting circuit 337.

Figure 6:
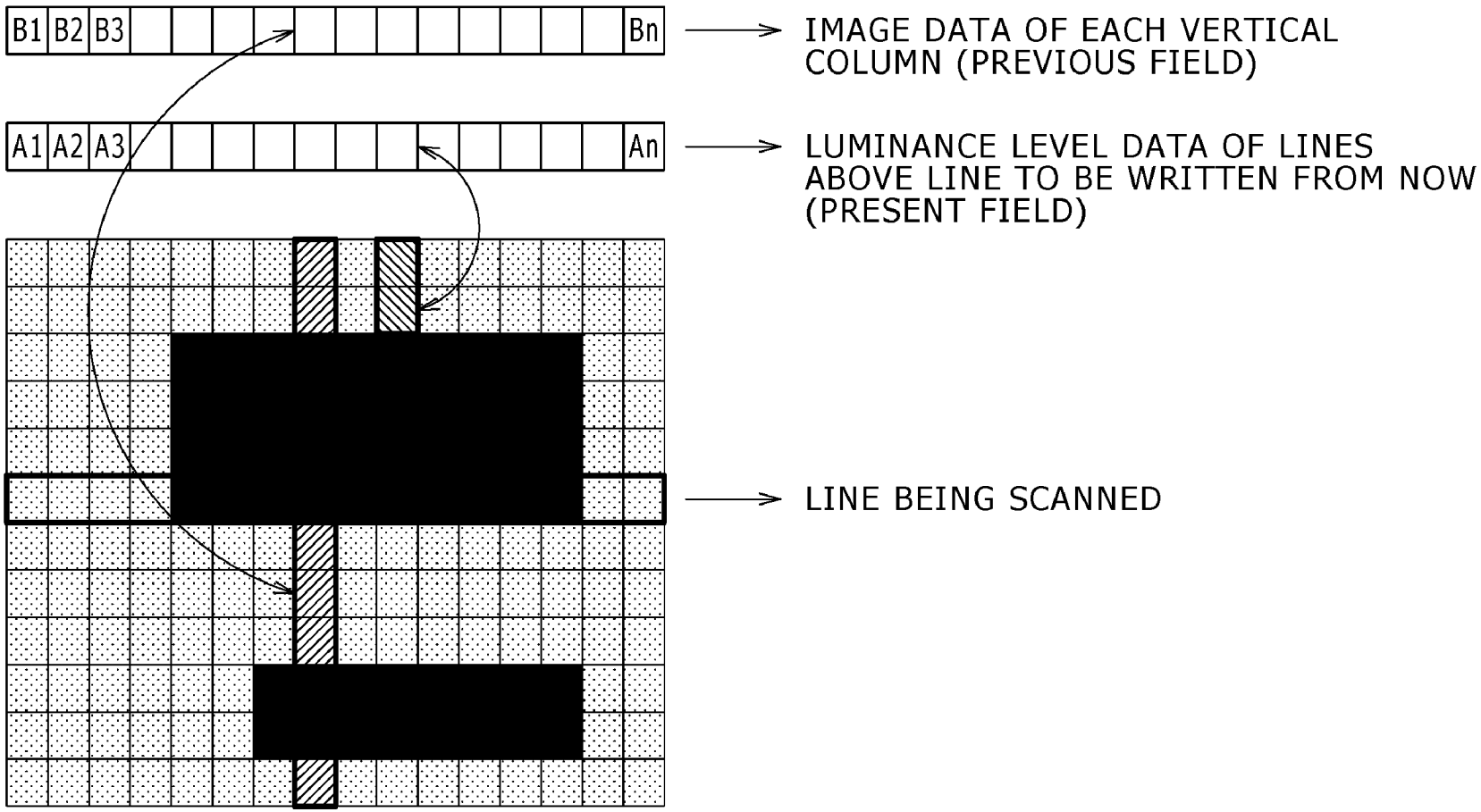
FIG. 6 is a diagram showing relation between data stored in two line memories.

The adder 331 performs addition processing on the double-speed image data output from the field memory 31 which processing is different between the first field and the second field. Specifically, in the first field, the adder 331 stores luminance information (luminance level data) of a first line (row) in the image data of the field in the line memory 333 via the selector switch 332. From a next line on down, the adder 331 repeats throughout one screen an operation of making an addition to luminance information accumulated in each column up to one immediately preceding line and thereby updating the data stored in the line memory 333. As a result, as shown in FIG. 6, sum total luminance information B1 to Bn accumulated in each column for all the lines of the image data of the first field is retained in the line memory 333.

Further, in the second field, the adder 331 stores luminance information of a first line (row) in the image data of the field in the line memory 334 via the selector switch 332. From a next line on down, the adder 331 repeats an operation of making an addition to luminance information accumulated in each column up to one immediately preceding line and thereby updating the data stored in the line memory 334. As a result, as shown in FIG. 6, sum total luminance information A1 to An accumulated in each column up to a line immediately preceding a line to be written from now (or up to the line to be written from now) of the image data of the second field is retained in the line memory 334.

Incidentally, in a first field of a next frame, sum total luminance information accumulated in each column for all the lines of the second field of the previous frame is retained in the line memory 334, and sum total luminance information accumulated in each column up to a line immediately preceding a line to be written in the first field of the next frame is retained in the line memory 333. The luminance information retained in the line memories 333 and 334 is cleared by the double-speed synchronizing signal of 120 Hz.

The selector switch 332 is switched by the field selecting signal supplied from the control circuit 32. The selector switch 332 selects the line memory 333 side when the field selecting signal FSP is at the "L" level, and selects the line memory 334 side when the field selecting signal FSP is at the "H" level. The selection of the line memory 333/334 by the selector switch 332 enables the above-described addition process by the adder 331.

When the field selecting signal FSP supplied from the control circuit 32 is at the "H" level, the correcting operation unit 335 subjects the image data of a second field of the double-speed image data output from the field memory 31 to an operation process for correcting vertical crosstalk, using sum total luminance information for all the lines of a first field which information is retained in the line memory 333 and sum total luminance information up to a line immediately preceding a line to be written in the second field which information is retained in the line memory 334. Details of the operation process will be described later.

The data selecting unit 336 alternatively outputs the double-speed image data output from the field memory 31 or the image data corrected by the correcting operation unit 335 on the basis of the field selecting signal FSP supplied from the control circuit 32. Specifically, the data selecting unit 336 selects the image data of a first field output from the field memory 31 and outputs the image data as it is when the field selecting signal FSP is at the "L" level. The data selecting unit 336 selects and outputs the image data of a second field corrected by the correcting operation unit 335 when the field selecting signal FSP is at the "H" level.

As a result of the selecting operation of the data selecting unit 336, vertical crosstalk correction for image data is activated once in two fields of the double-speed image data output from the field memory 31, that is, the vertical crosstalk correction is activated for the image data of the second field. Hence, since image data is the same between the fields where correcting operation is performed, the same correction result as in the case of correcting a still image can be obtained for a moving image.

As described above, in the active matrix type liquid crystal display device 10 using the field inversion driving system, input image data is converted into double-speed image data having a field frequency twice the field frequency of the image data, and of two fields as a unit of the double-speed image data, information of the first field is used to correct crosstalk in the second field. Thus, since the image data is not changed between the two fields as a unit, a similar correction to that for a still image can be made for a moving image without use of a large-scale memory having a capacity to store display data for one screen. Incidentally, the field memory 31 is provided for double-speed conversion in a display device in related art using the double-speed driving system.

(Moving Image Detection)

The moving image detecting circuit 337 detects whether image data being written now is the image data of a moving image on the basis of the data retained in each of the line memories 333 and 334 at a point in time when the writing of image data of a first field is completed.

At the point in time when the writing of the image data of the first field is completed, the line memory 333 retains sum total luminance information accumulated in each column for the image data of the first field of a present frame, and the line memory 334 retains sum total luminance information accumulated in each column for the image data of a second field of a previous frame.

The respective pieces of sum total luminance information of the line memories 333 and 334 match each other in the case of a still image and there is a difference between the two pieces of sum total luminance information in the case of a moving image. Accordingly, the moving image detecting circuit 337 obtains a difference between the respective pieces of sum total luminance information of the line memories 333 and 334, and determines that the image data being written now is the image data of a still image when the difference is zero and determines that the image data being written now is the image data of a moving image when the difference is other than zero.

A result of the detection (a result of the determination) of the moving image detecting circuit 337 is supplied to the timing generating circuit 322 within the control circuit 32. Receiving the result of the detection of the moving image detecting circuit 337, the timing generating circuit 322 controls the polarity state of the field selecting signal FSP such that the field selecting signal FSP is at the "L" level for the first field of the double-speed image data and is at the "H" level for the second field of the double-speed image data.

Reasons for performing the moving image detection by the moving image detecting circuit 337 will be described below. At a time of starting the system (turning on power), the polarity state of the field selecting signal FSP generated by the timing generating circuit 322 may be undetermined and reversed due to some factor, that is, the field selecting signal FSP may be at the "H" level in the first field and at the "L" level in the second field. The reversed polarity of the field selecting signal FSP may not achieve the intended purpose of making a similar image data correction to that of a still image for a moving image by correcting vertical crosstalk in the second field of the double-speed image data.

Thus, the moving image detecting circuit 337 first detects a moving image on the basis of the respective pieces of sum total luminance information of the line memories 333 and 334 between frames. Receiving a result of the detection of the moving image detecting circuit 337, in the case of a moving image, the timing generating circuit 322 controls the polarity state of the field selecting signal FSP such that the field selecting signal FSP is at the "L" level for the first field of a next frame and is at the "H" level for the second field. Thus the correcting operation unit 335 can reliably correct the second field of double-speed image data on the basis of the field selecting signal FSP.

The same as in the case of the field selecting signal FSP applies to the polarity specifying signal FRP. Specifically, at a time of starting the system, the polarity state of the polarity specifying signal FRP generated by the timing generating circuit 322 may be undetermined and reversed due to some factor, that is, the polarity specifying signal FRP may be at the "L" level in the first field and at the "H" level in the second field. When the polarity of the polarity specifying signal FRP is reversed, the polarity of the analog image signal input from the driver 34 to the display panel 20 is reversed in the first field and the second field of double-speed image data, that is, the polarity of the analog image signal is negative polarity in the first field and positive polarity in the second field.

The present inventor has confirmed that the following problems occur when the polarity of the analog image signal input to the display panel 20 is thus negative polarity in the first field and positive polarity in the second field.

When an amount of leakage of a pixel transistor differs depending on the polarity of a potential retained by a pixel and a leakage on one polarity side is dominant, a field to be corrected in vertical crosstalk correction for a moving image may have a polarity of less leakage. It is known that this is attributed to characteristics of the pixel transistor, or the N-type TFT 41 (see FIG. 2) in the present example, that the amount of leakage increases when a gray level on a negative side is retained and further a black level on the negative side is written, and that the amount of leakage decreases when a gray level on a positive side is retained and further a black level on the positive side is written.

Figure 7:
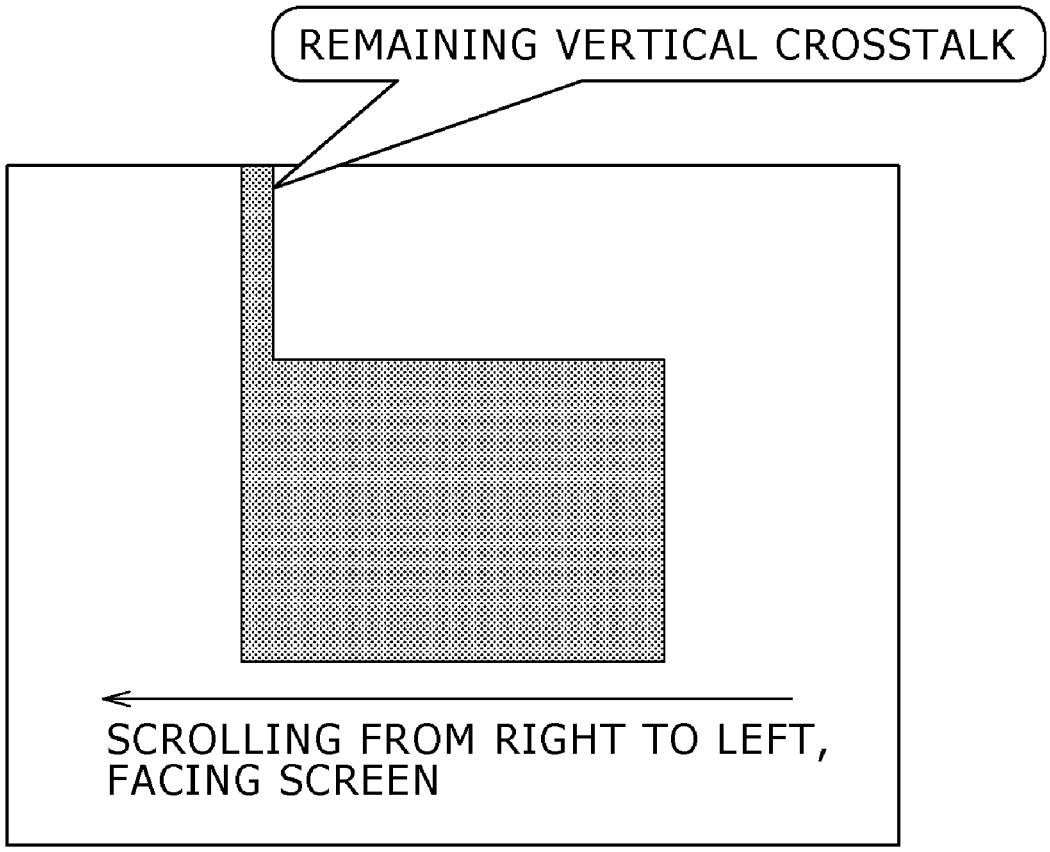
FIG. 7 is a diagram showing a state in which a part where vertical crosstalk cannot be corrected remains in a front in a direction of movement of a black window.

Thus, in the above-described polarity state, that is, in the state in which the polarity of the analog image signal is negative polarity in the first field and positive polarity in the second field, crosstalk correction is made in the second field in which the amount of leakage is smaller. Consequently, since a field in which a black window moves is the first field with a larger amount of leakage, a part in which vertical crosstalk not being corrected remains in a front in a direction of movement of the black window, as shown in FIG. 7.

In order to prevent such a problem, the timing generating circuit 322 performs a resetting operation in timing in which a vertical synchronizing signal VSYNC is externally supplied. The timing generating circuit 322 thereby controls the polarity of the polarity specifying signal FRP such that the polarity of the polarity specifying signal FRP is at the "H" level in the first field and at the "L" level in the second field, that is, such that the field with the larger amount of leakage is the second field.

Thus, by setting the polarity of the polarity specifying signal FRP at the "H" level in the first field and at the "L" level in the second field, and setting the second field as the field with the larger amount of leakage, it is possible to reliably correct the vertical crosstalk in the front in the direction of movement of the black window. Therefore vertical crosstalk correction can be made more surely for moving images.

Figure 8:
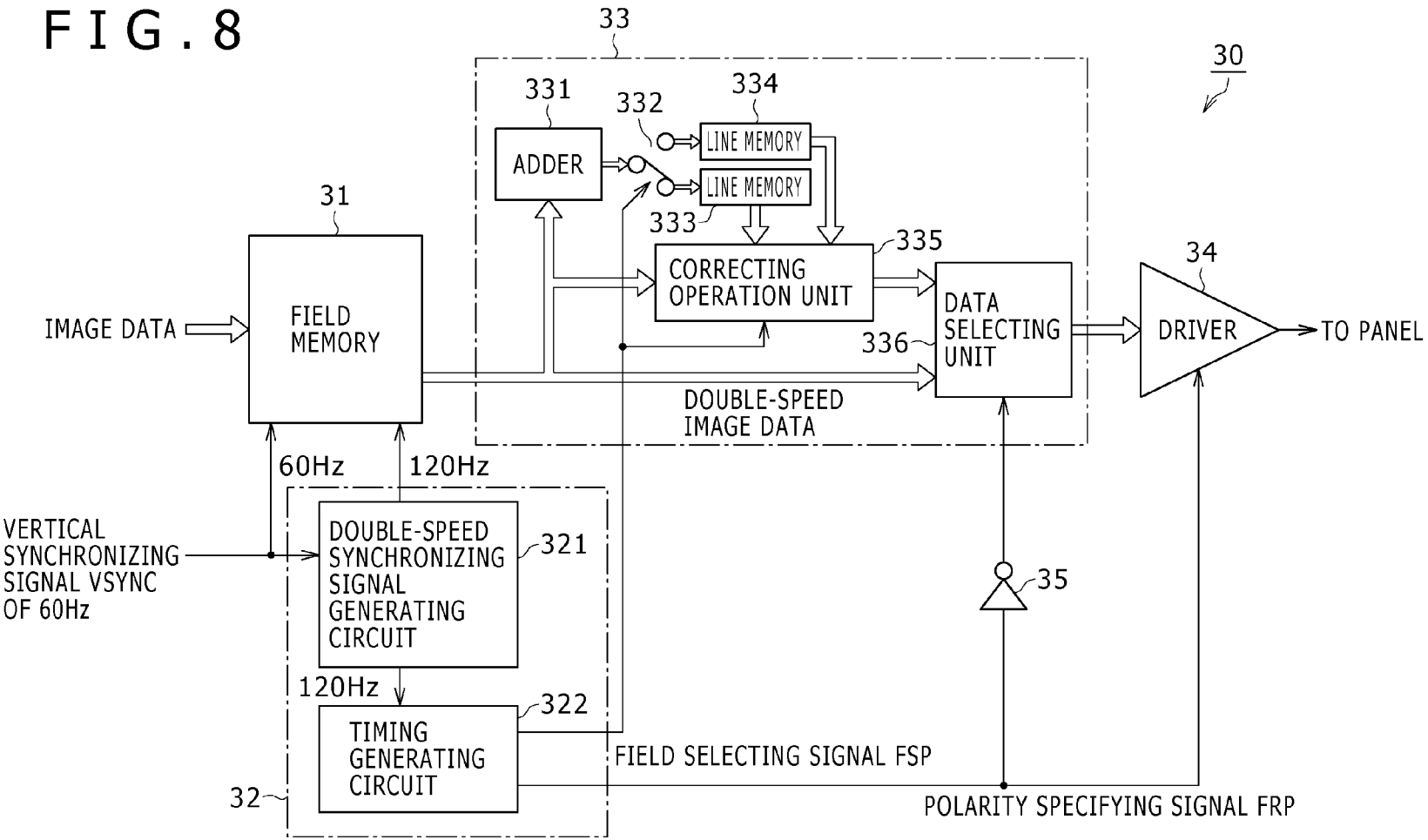
FIG. 8 is a functional block diagram of a driving circuit including a vertical crosstalk correcting circuit according to another embodiment of the present invention.

Incidentally, the present embodiment controls the data selecting unit 336 using the field selecting signal FSP generated separately from the polarity specifying signal FRP by the timing generating circuit 322. However, as shown in FIG. 8, crosstalk can be corrected in the second field of double-speed image data also when the polarity of the polarity specifying signal FRP is inverted by an inverter 35 as inverting means, and the inverted polarity specifying signal FRPX having the inverted polarity is used as a signal for controlling the data selecting unit 336 in place of the field selecting signal FSP.

Thus, using the inverted polarity specifying signal FRPX in place of the field selecting signal FSP has an advantage of allowing the moving image detecting circuit 337 to be omitted and correspondingly simplifying the circuit configuration of the vertical crosstalk correcting circuit 33 because polarity specification by the polarity specifying signal FRP enables correction to be performed in the second field without detection of a moving image using the moving image detecting circuit 337 and without control of the polarity state of the field selecting signal FSP.

(Vertical Crosstalk Correction)

Figure 9:
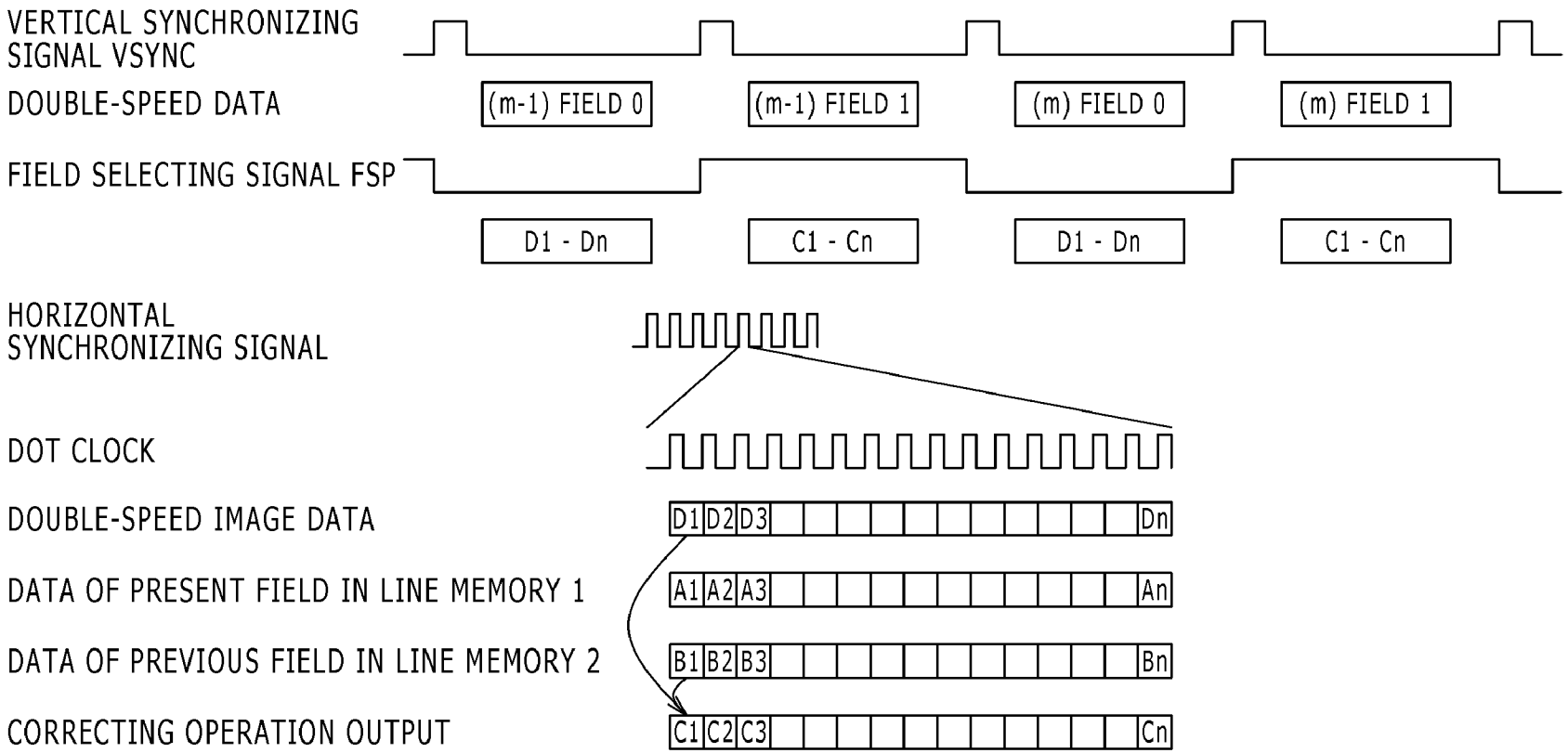
FIG. 9 is a timing chart of assistance in explaining operation for vertical crosstalk correction.

Vertical crosstalk correction performed by the vertical crosstalk correcting circuit 33 formed as described above will next be described with reference to a timing chart of FIG. 9.

After data retained in the line memories 333 and 334 is cleared by a double-speed synchronizing signal of 120 Hz, addition processing by the adder 331 is performed for a first field of double-speed image data output from the field memory 31. Thereby sum totals A1 to An of luminance level data (luminance information) in respective vertical columns for all the lines are stored in the line memory 333, the sum totals being equal in number to the number n of pixels in a horizontal direction.

Next, addition processing by the adder 331 is performed for a second field of the double-speed image data output from the field memory 31. Thereby sum totals B1 to Bn of luminance level data in respective vertical columns up to a line immediately preceding a line (row) to be written from now (including the line to be written from now in some cases) are stored in the line memory 334, the sum totals B1 to Bn being equal in number to the number n of pixels in the horizontal direction.

Incidentally, a sum total of all image data of one vertical column becomes a very massive amount of data. The amount of data can be reduced by providing thresholds for image data input to the adder 331, assigning weights according to gradation level (luminance level), and adding the weights. In this case, sum totals A1 to An and B1 to Bn of luminance level data are sum totals of weight data.

Figure 10:
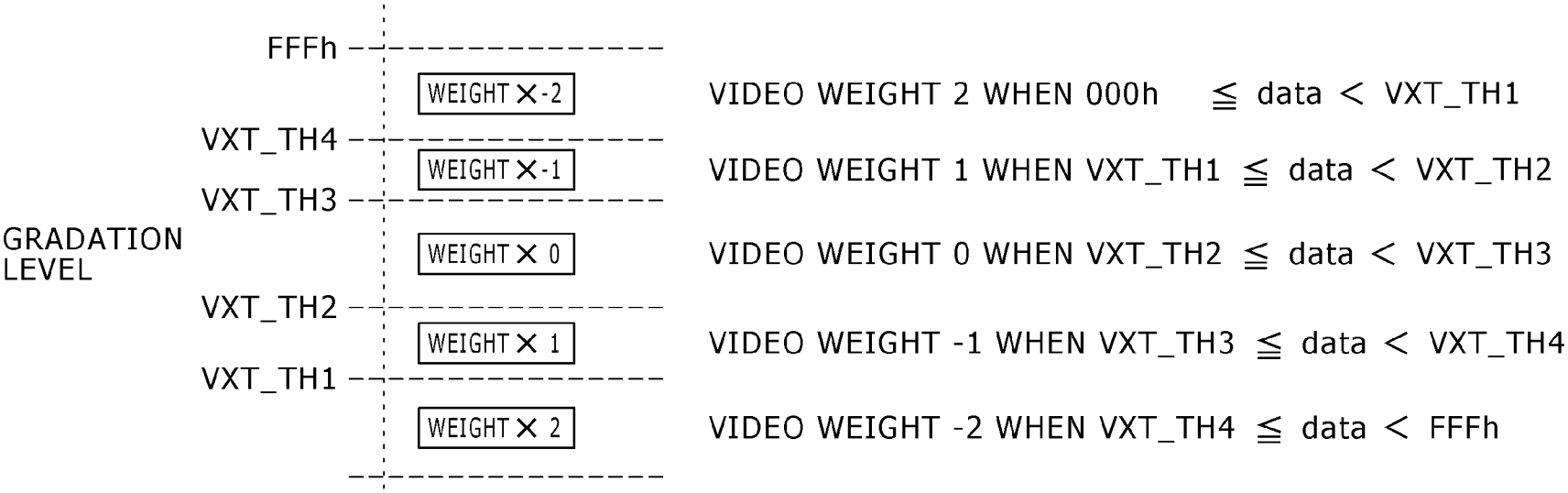
FIG. 10 is a diagram of assistance in explaining assignment of weights to image data according to gradation level.

For example, as shown in FIG. 10, thresholds VXT_TH1 to VXT_TH4 are provided. When data is equal to or higher than 000*h* and lower than VXT_TH1, that is, the data has a black level, a weight of 2 is assigned. When data is equal to or higher than VXT_TH1 and lower than VXT_TH2, that is, the data has a dark gray level, a weight of 1 is assigned. When data is equal to or higher than VXT_TH2 and lower than VXT_TH3, a weight of 0 is assigned. When data is equal to or higher than VXT_TH3 and lower than VXT_TH4, that is, the data has a pale gray level, a weight of −1 is assigned. When data is equal to or higher than VXT_TH4 and lower than FFFh, that is, the data has a white level, a weight of −2 is assigned.

An amount of crosstalk, that is, an amount of leakage of a pixel transistor (TFT 41 in FIG. 2) depends on a degree of variation of the signal line 23 during a period when a signal is written to the pixel and retained in the pixel with respect to the retained voltage. Hence, an amount of correction of vertical crosstalk is determined by a difference between a sum total of signal levels on an upper side of a pixel to be written and a sum total of signal levels on a lower side of the pixel to be written, and a writing voltage.

Accordingly, the correcting operation unit 335 calculates an amount of correction a from the following Equation (1) on the basis of respective pieces of luminance level data (sums of luminance weight data) retained in the line memories 333 and 334.

$$\alpha = a*(B-A) - b*A \tag{1}$$

In the above Equation (1), "A" is a sum of luminance weight data up to a line immediately preceding a line to be written (including the line to be written from now in some cases) in an Nth field, and "B" is a sum of luminance weight data on all lines of an (N−1)th field. "a" is a correction coefficient (scan forward correction coefficient) for a vertical crosstalk appearing on an upper side of a black window, and "b" is a correction coefficient (scan rearward correction coefficient) for a vertical crosstalk appearing on a lower side of the black window.

When correction is performed in an area on the upper side of the black window, supposing that a sum A of luminance weight data up to the immediately preceding line is treated as zero, an amount of correction a in the area on the upper side of the black window is $\alpha = a*B$. The amount of correction a in the black window is $\alpha = a*(B-A)$. The amount of correction a in an area on a lower side of the black window is $\alpha = b*A$. The correction coefficients a and b allow the amount of correction a to be set independently for vertical crosstalks occurring on the upper side and the lower side of the black window which crosstalks are different from each other in polarity and occurring amount.

Figures 11A, 11B:
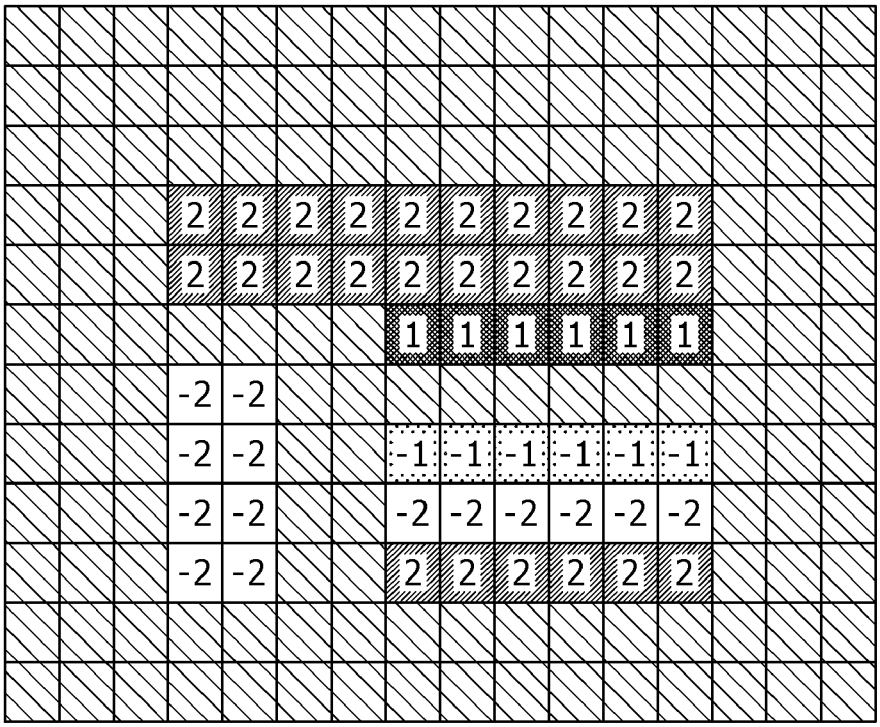
FIGS. 11A and 11B are diagrams (1) of assistance in explaining a concrete example of vertical crosstalk correction.
Figure 13B:
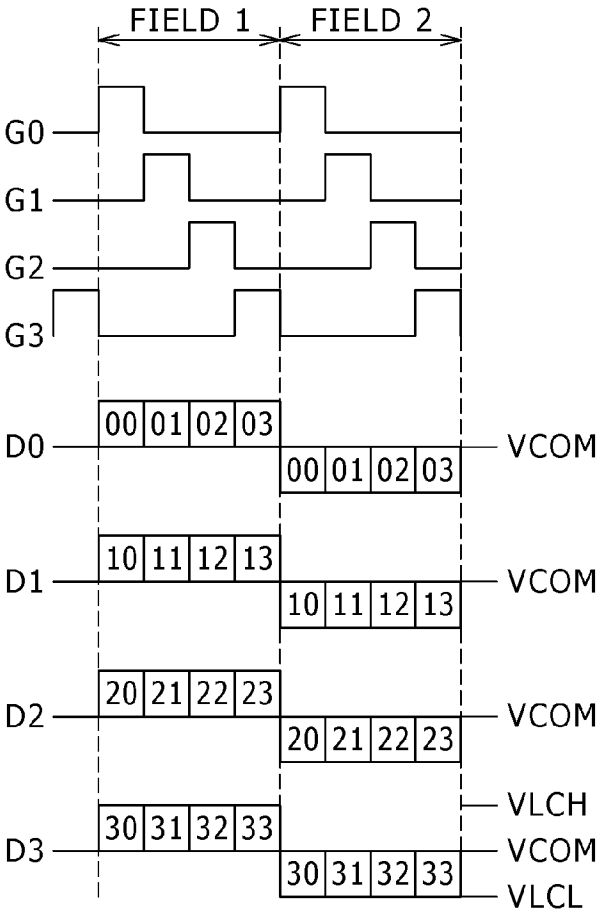
FIGS. 13A and 13B are diagrams of assistance in explaining a field inversion driving system that inverts the polarity of a display signal in field periods.
Figure 13A:
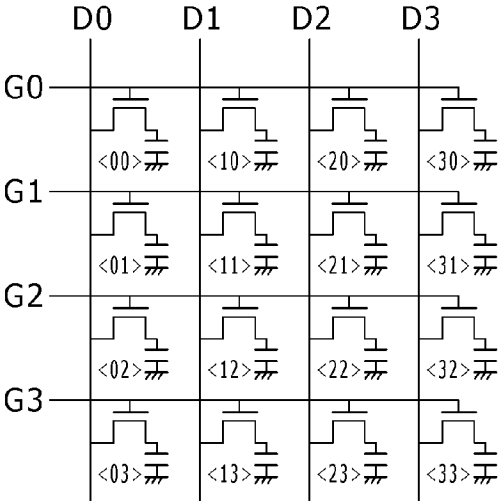

Consideration will be given to a case as an example where weights are assigned to image data as shown in FIG. 11A in a pixel arrangement of vertical 12×horizontal 16. Numbers in the image in FIG. 11A represent weights. In this case, a sum B of luminance weights on all lines of an (N−1)th field which sum is retained in one line memory 333 is as shown in FIG. 11B, and a sum A of luminance weights up to a line immediately preceding a line to be written in an Nth field which sum is retained in the other line memory 334 is as shown in FIG. 12A.

Setting the correction coefficient a for a vertical crosstalk appearing on the upper side of a black window to three and setting the correction coefficient b for a vertical crosstalk appearing on the lower side of the black window to two, an amount of correction $\alpha$ for each pixel is as shown in FIG. 12B from the above equation in the pixel arrangement of vertical 12×horizontal 16. The correcting operation unit 335 corrects the vertical crosstalks by superimposing the amount of correction a on the gradation level of image data in the second field to be written from now.

Thus, a sum B of luminance weight data on all lines of an (N−1)th field is retained in the line memory 333/334, and a sum A of luminance weight data up to a line immediately preceding a line to be written in an Nth field (including the line to be written from now in some cases) is retained in the line memory 334/333. A correcting process is performed using the sum B of the luminance weight data and also the sum A of the luminance weight data and using the independent correction coefficients a and b. Thereby, even for vertical crosstalk specific to the field inversion driving system, that is, vertical crosstalks whose amounts of crosstalk are different in an area over a black area and an area under the black area, the best correcting process dealing with the different amounts of crosstalk can be realized by setting the correction coefficients a and b.

Incidentally, in this vertical crosstalk correcting process, a second field of double-speed image data is corrected, and thus a first field is not subjected to correction, of course. Accordingly, correction is performed with amounts of correction larger than in a case of the related art correcting each field, for example amounts of correction about twice those of the case in related art, for example. The amounts of correction in this case can be set by the correction coefficients a and b.

Thus, correcting the second field with amounts of correction larger than for one field can produce same effects as in a case where the first field is also corrected in a pseudo manner because the amounts of correction are averaged (integrated) between the two fields as a unit of double-speed image data.

It is to be noted that while the foregoing embodiments have been described by taking as an example a case where the present invention is applied to an active matrix type liquid crystal display device using liquid crystal cells as electrooptic elements of pixels, the present invention is not limited to applications to liquid crystal display devices, but is applicable to display devices in general employing a field inversion driving system.

It should be understood by those skilled in the art that various modifications, combinations, sub-combinations and alterations may occur depending on design and other factors insofar as they are within the scope of the appended claims or the equivalents thereof.

What is claimed is:

1. A display device comprising:

a display panel comprising a plurality of pixels, each pixel including an electrooptic element, said plurality of pixels arranged in a form of a matrix; and a driving circuit, said driving circuit using a field inversion driving system for inverting polarity of a display signal to be written to each of said pixels in field periods, said driving circuit comprising (a) a double-speed convertor, comprising a field memory and a control circuit, converts an input display signal into a double-speed display signal having a field frequency twice a field frequency of said display signal; and (b) a crosstalk correcting circuit, comprising a first line memory and a second line memory, corrects crosstalk between a first field and a second field as a unit of said double-speed display signal generated by said double-speed, wherein, the first line memory is configured to retain sum total luminance information accumulated in each column for all rows of image information of the first field, the second line memory is configured to retain sum total luminance information accumulated in each column for certain rows of image information of the second field; said certain rows comprising rows up to one of (i) a line immediately preceding a row to be written and (ii) the row to be written, and a correcting operation unit performs a correcting operation using an independent correction coefficient for each correction area on a basis of the information retained in said first line memory and said second line memory.

2. The display device as claimed in claim 1, further comprising:

a moving image detecting circuit for detecting whether image information being written now is image information of a moving image on the basis of the information retained in said first line memory and said second line memory at a point in time when writing of the image information of the first field is completed; and a timing generating circuit for generating a field selecting signal to select said double-speed display signal of the first field with a first polarity and select the display signal of the second field corrected by said crosstalk correcting circuit with a second polarity when said moving image detecting circuit detects a moving image.

3. The display device as claimed in claim 1, further comprising:

a timing generating circuit for generating a polarity specifying signal that has a second polarity in the first field of the double-speed display signal and has a first polarity in the second field of the double-speed display signal at a time of a system boot, wherein, said polarity specifying signal performs polarity control so as to supply the display signal of negative polarity to each of said pixels when said polarity specifying signal is of the first polarity, and supply the display signal of positive polarity to each of said pixels when said polarity specifying signal is of the second polarity.

4. The display device as claimed in claim 3, further comprising:

an inverter for inverting polarity of said polarity specifying signal, wherein, said double-speed display signal of the first field is selected when an inverted polarity specifying signal whose polarity is inverted by said invertor is of a first polarity, and the display signal of the second field corrected by said crosstalk correcting circuit is selected when the inverted polarity specifying signal is of a second polarity.

5. A driving method of a display device using a field inversion driving system, said display device being formed by arranging pixels each including an electrooptic element in a form of a matrix and inverting polarity of a display signal to be written to each of said pixels in field periods, said driving method comprising the steps of:

converting an input display signal into a double-speed display signal having a field frequency twice a field frequency of said display signal; and performing crosstalk correction with a crosstalk correcting circuit, said crosstalk correcting circuit comprising a first line memory and a second line memory, between a first field and a second field as a unit of said double-speed display signal, wherein, a first line memory is configured to retain sum total luminance information accumulated in each column for all rows of image information of the first field, the second line memory is configured to retain sum total luminance information accumulated in each column for certain rows of image information of the second field;

said certain rows comprising rows up to one of (i) a line immediately preceding a row to be written and (ii) the row to be written, and a correcting operation unit performs a correcting operation using an independent correction coefficient for each correction area on a basis of the information retained in said first line memory and said second line memory.

* * * * *